US007659861B2

(12) United States Patent
Jan

(10) Patent No.: US 7,659,861 B2
(45) Date of Patent: Feb. 9, 2010

(54) DUAL FREQUENCY FEED ASSEMBLY

(75) Inventor: Cheng-Geng Jan, Hsinchu (TW)

(73) Assignees: Wistron NeWeb Corp. (TW); Cheng-Geng Jan (TW)

( * ) Notice: Subject to any disclaimer, the term of this patent is extended or adjusted under 35 U.S.C. 154(b) by 0 days.

(21) Appl. No.: 12/014,080

(22) Filed: Jan. 14, 2008

(65) Prior Publication Data

US 2009/0179809 A1 Jul. 16, 2009

(51) Int. Cl.
*H01Q 13/00* (2006.01)
*H01Q 1/50* (2006.01)

(52) U.S. Cl. ..... 343/772; 343/776; 343/785; 343/786; 343/860

(58) Field of Classification Search ..... 343/772, 343/785, 786
See application file for complete search history.

(56) References Cited

U.S. PATENT DOCUMENTS 5,793,334 A * 8/1998 Anderson et al. ..... 343/786
6,700,548 B1 * 3/2004 Chen et al. ..... 343/771
6,714,165 B2 * 3/2004 Verstraeten ..... 343/772
2002/0171597 A1 * 11/2002 Krishmar-Junker et al. . 343/786

* cited by examiner

*Primary Examiner*—Vibol Tan
*Assistant Examiner*—Dylan White
(74) *Attorney, Agent, or Firm*—Martine Penilla & Gencarella, LLP

(57) ABSTRACT

The invention discloses a dual frequency feed assembly for receiving signals of both a first band and a second band lower than the first band, or transmitting signals of one of the first band and the second band while receiving signals of the other band. The dual frequency feed assembly includes an orthogonal-mode transducer, which includes: a core unit having an inner waveguide, an outer waveguide with a diameter larger than that of the inner waveguide and the two waveguides being concentric, a first band output/input port connected to the inner waveguide, and a second band output/input port; and two or four detachable branch waveguides connected to the core unit. An O-ring is provided at each connection between the core unit and the branch waveguides. The dual frequency feed assembly further comprises a first band polarizer made of a metal septum and/or a second band polarizer made of dielectric slabs, when receiving circularly polarized signals. Both of them can be provided in the inner waveguide or the outer waveguide, respectively, which makes the feed assembly design more compact and suitable for mass production.

20 Claims, 6 Drawing Sheets

DUAL FREQUENCY FEED ASSEMBLY

BACKGROUND OF THE INVENTION a) Field of the Invention

The invention relates to a dual frequency feed assembly and, more particularly, to a dual frequency feed assembly that can simultaneously receive dual frequency signals, or receive and transmit signals at two frequency bands.

b) Description of Related Art

In the past, satellites broadcast signals at Ku-band, which has a low frequency range at about 12 GHz. Due to the increasing need for information, another satellite that broadcasts signals at Ka-band with a higher frequency ranging from 20 GHz to 30 GHz is placed in the same geosynchronous orbit with the Ku-band satellites. Now signals are generally broadcasted at two frequencies, Ka-band and Ku-band, and the reception of these dual frequency signals is still expected to be carried out with just one antenna.

A reflector antenna is often used as a receiving antenna by placing a dual frequency feed assembly at the focus of the reflector antenna to separate the collected signals. Referring to FIG. 1, a feed assembly may include a feedhorn 11 and an orthogonal-mode transducer (OMT) 12. The OMT 12 separates signals in different frequency bands (high and low) and separates signals in different polarizations. The OMT 12 further includes two output/input ports 13, 14, wherein one is high frequency output/input port (Ka-band) and one is low frequency output/input port (Ku-band), and the output/input ports can be further connected to a down converter or act as an input port for a transmitter.

U.S. Pat. No. 5,003,321 discloses a structure having a concentric feed and a plurality of interconnecting waveguides, and the need to simultaneously receive signals in different frequency bands is satisfied thereby. However, the structure of '321 patent is composed of two complex units, which makes mass production difficult. Moreover, it is hard to waterproof the components in the structure, and so signal distortion and attenuation may occur easily.

U.S. Pat. No. 6,714,165 discloses a structure similar to that of '321 patent but with improvement on the division of units, wherein the cutting surface is designed to be in the interconnecting waveguides, and therefore O-ring can be applied for waterproof purpose. However, although the cutting design of '165 patent is more effective in providing water resistance to the structure, the assembly of the structure is still complex in industrial manufacture, and therefore the need and goal for mass production cannot be well met. Furthermore, the two aforementioned conventional technologies only disclose conditions concerning linearly polarized antenna, whereas designs relating to circularly polarized antenna are not mentioned.

SUMMARY OF THE INVENTION

The invention provides a dual frequency feed assembly that is capable of receiving signals of both a first band and a second band lower than the first band, or receiving signals of one of the first band and the second band while transmitting signals of the other band. The dual frequency feed assembly includes an OMT, which has a core unit having an inner waveguide, an outer waveguide with a diameter larger than that of the inner waveguide, wherein the two waveguides are concentric, a first band output/input port connected to the inner waveguide, and a second band output/input port; and two or four detachable branch waveguides, wherein each of the branch waveguides lacks a side wall and uses an outer wall of the core unit as its side wall, as it is disposed with the hollow portion facing the core unit and joined thereto across a first plane substantially parallel to a longitudinal axis of the core unit. The second band signals travel from the outer waveguide to the second band output/input port via at least one of the branch waveguides.

The invention also provides a dual frequency feed for receiving dual frequency signals including circularly polarized signals of a first band and a second band lower than the first band. The dual frequency feed includes: an inner waveguide; a first band polarizer provided in the inner waveguide; an outer waveguide concentric with the inner waveguide, wherein the diameter of the outer waveguide is larger than the diameter of the inner waveguide; a second band polarizer provided in the outer waveguide; two or four branch waveguides connected to the outer waveguide; a first band output/input port through which a left-hand circularly polarized signal in the first band and a right-hand circularly polarized signal in the first band are conducted to a down converter or a transmitter; a first connection connecting the inner waveguide and the first band output/input port; and a second band output/input port connected to at least one of the branch waveguides. The circularly polarized signals of the first band enter the inner waveguide, and the circularly polarized signals of the second band enter the outer waveguide and are conducted to the second band output/input port through the branch waveguides. The first band polarizer is made of metal septum and/or the second band polarizer is made of dielectric slabs.

The dual frequency feed assembly of the invention is divided differently in comparison to the two aforementioned disclosures. The metal part of the dual frequency feed assembly of the invention can be divided into five parts, a core unit, including a feedhorn, and four independent branch waveguides. This cutting design allows each part to be mass-produced by conventional die-casting molding methods, and then the parts can be easily assembled to complete the dual frequency feed assembly.

In addition, the invention includes conventional O-rings provided at the junctions between the core unit and each of the branch waveguides as effective waterproof devices, and each branch can include a filter therein to filter noise. Furthermore, the invention provides the built-in polarizer concept. Although a polarizer can be externally connected to the conventional technology, the product size, as well as the cost, will increase. The built-in polarizer structure of the invention achieves the goal of mass production by die-casting molding at low production cost.

DETAILED DESCRIPTION OF THE INVENTION

Figure 1:
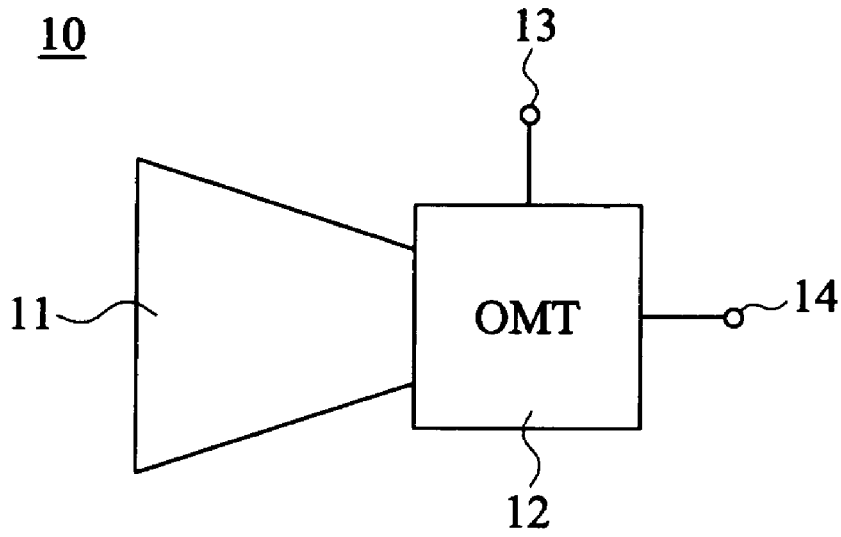
FIG. 1 (PRIOR ART)
FIG. 1 is a structural diagram of a general dual frequency feed assembly.

The preferred embodiments of a dual frequency feed assembly according to the invention will be described in detail with reference to the drawings, in which like reference numerals denote like components.

Figure 2:
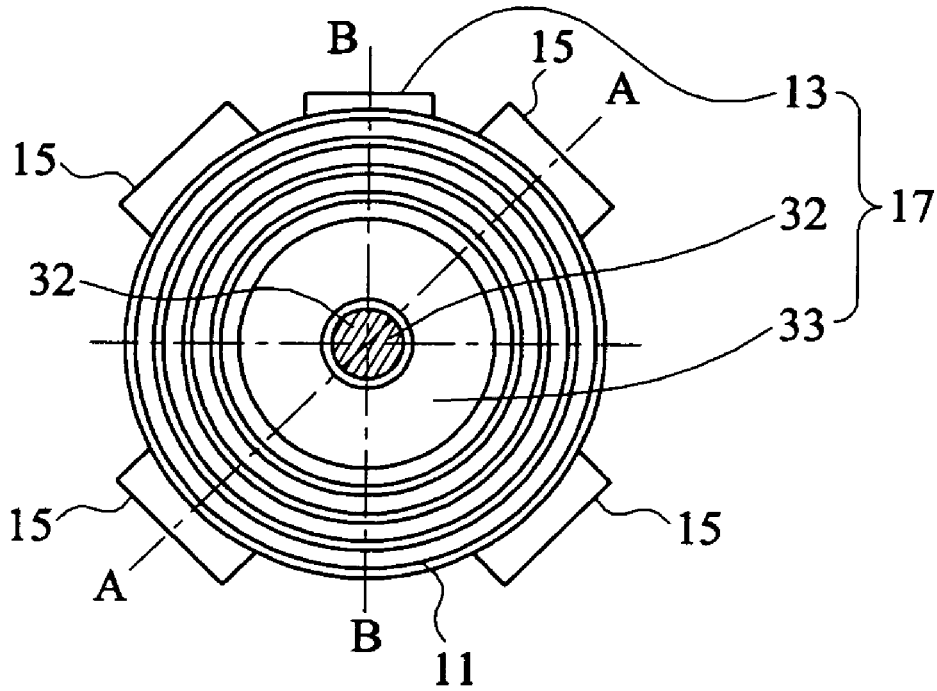
FIG. 2 is a side view of a dual frequency feed assembly according to an embodiment of the invention.

A dual frequency feed assembly of the invention will be described in detail with reference to FIGS. 2 to 4. FIG. 2 illustrates a dual frequency feed assembly according to an embodiment of the invention that is viewed from the feedhorn side. A dual frequency feed assembly includes a feedhorn 11, a dielectric rod 31, and an OMT having a core unit 17 and four detachable branch waveguides 15. The core unit 17 includes: an inner waveguide 32 with smaller diameter, wherein the dielectric rod 31 is provided; an outer waveguide 33 with larger diameter and concentric with the inner waveguide 32; a first band output/input port 13, which is connected to the inner waveguide 32 and can be connected to a down converter or a transmitter (not shown); and a second band output/input port 14 (shown in FIG. 3). The four detachable branch waveguides 15 are connected to the core unit 17, whereby signal waves in the four branch waveguides 15 are recombined and output to the second band output/input port 14. The branch waveguides 15 allow second band signals to be conducted between the outer waveguide 33 and the second band output/input port 14. O-rings (not illustrated) are provided at junctions between the core unit 17 and the branch waveguides 15. The branch waveguides 15 each lacks one side wall so that it can be stripped from the mold easily. The branch waveguides 15 are disposed with the hollow portion facing the core unit 17 and joined thereto across a first plane substantially parallel to a longitudinal axis of the core unit 17. An outer wall of the core unit 17 is used as the missing side wall of the branch waveguides 15.

Figure 3:
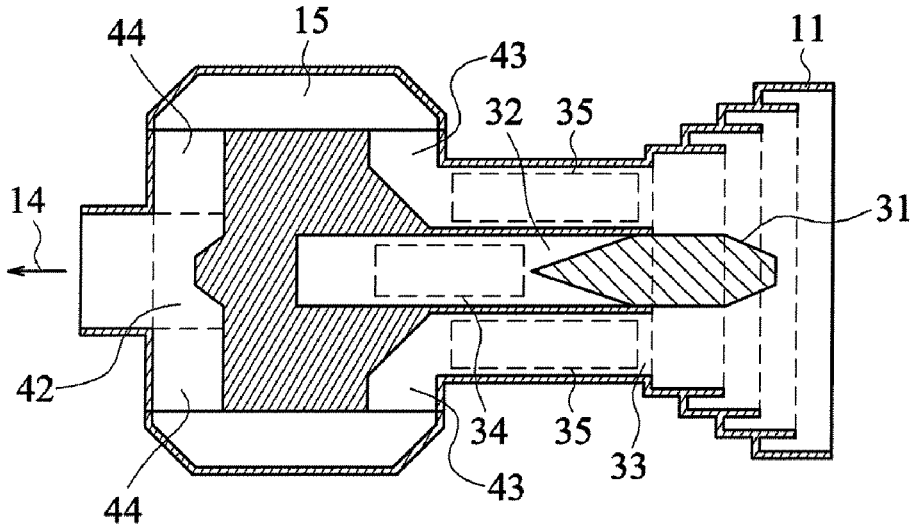
FIG. 3 is a sectional view dissected along line A-A of FIG. 2.

FIG. 3 is a sectional view of the dual frequency feed assembly of the invention. Referring to FIG. 3, the assembly further includes a first band polarizer 34 made of metal septum and a second band polarizer 35 made of dielectric slabs. When the assembly placed at the focus of a reflector antenna (not shown) receives, at the same time, circularly polarized signals of a first band and a second band lower than the first band, the circularly polarized signals of the second band would enter the outer waveguide 33 having a larger diameter. The circularly polarized signals of the second band are then transformed into linearly polarized waves via the second band polarizer 35 provided in the outer waveguide 33, and the linearly polarized waves are further divided into horizontally polarized waves and vertically polarized waves. The horizontally polarized waves and the vertically polarized waves each enter a pair of branch waveguides 15, and the waves in the two pairs of branch waveguides 15 are recombined and output through the second band output/input port 14 to a connected down converter or a connected transmitter (not shown). A waveguide 43 is disposed between the outer waveguide 33 and one end of the branch waveguide 15 so as to connect the two while the other end of the branch waveguide 15 is connected to another waveguide 44. A hollow waveguide 42 is connected to the waveguide 44 and the second band output/input port 14, thereby connecting the branch waveguide 15 and the second band output/input port 14. The purpose for the splitting and recombination of the four branch waveguides 15 is to suppress the undesired waveguide modes. The branch waveguides 15 are paired with the branch waveguide opposite thereto. Therefore, only two of the four branch waveguides 15 are utilized when a second band signal with only the vertically polarized waves or only the horizontally polarized waves is present for receive. In other words, the dual frequency feed assembly is composed of two branch waveguides instead of four branch waveguides when its function is to receive signals that include second band signals with single polarization.

Figure 4:
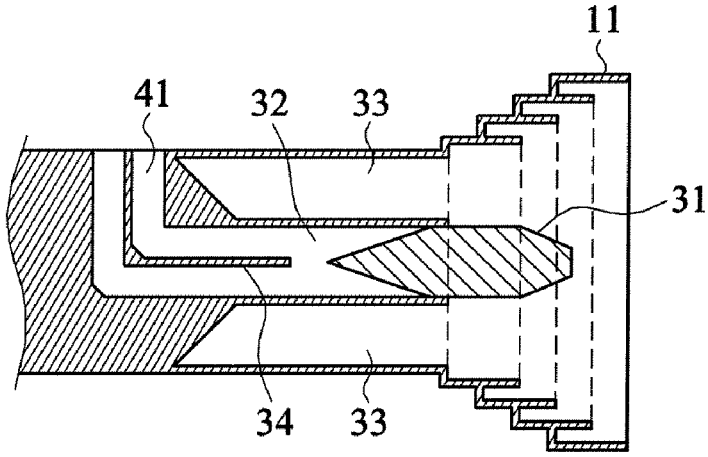
FIG. 4 is a sectional view dissected along line B-B of FIG. 2.
Figure 10:
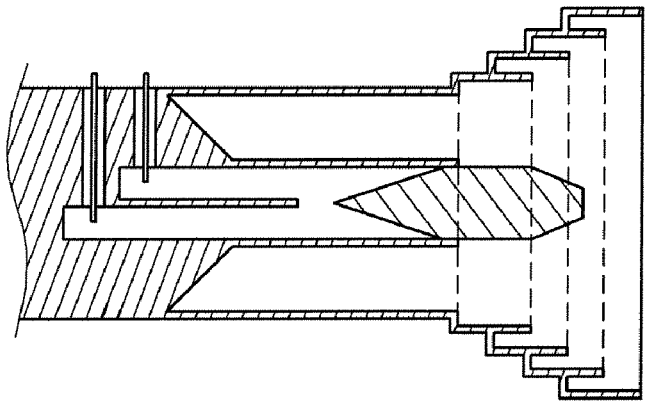
FIG. 10 is a schematic diagram illustrating left-hand and right-hand circularly polarized signals conducted by probes.

FIG. 4 is another sectional view of the dual frequency feed assembly of the invention. The circularly polarized signals of the first band are directed by the dielectric rod 31 and enter the inner waveguide 32 that is concentric with the outer waveguide 33 but with a smaller diameter. After being polarized by the first band polarizer 34, the left-hand circularly polarized signals and the right-hand circularly polarized signals of the first band are separated and each respectively enters an upper semicircular partition and a lower semicircular partition of the inner waveguide 32. The signals are conducted to the first band output/input port 13 by a bended waveguide 41 connecting the inner waveguide 32 and the first band output/input port 13, and thereafter the signals are output to a connected down converter or a connected transmitter (not shown) through the first band output/input port 13. The left-hand circularly polarized signals and the right-hand circularly polarized signals can also be respectively conducted to a down converter or a transmitter via two metal probes connected to the inner waveguide 32 as shown in FIG. 10 instead of via the bended waveguide 41 or other waveguides.

Figure 5A:
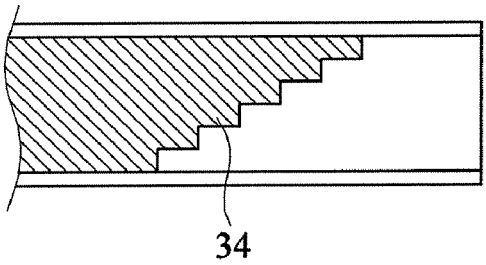
FIG. 5A is a structural diagram of a first band polarizer according to an embodiment of the invention.
Figure 5B:
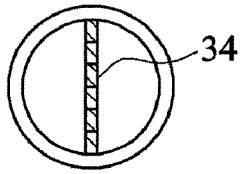
FIG. 5B is a side view of the first band polarizer of FIG. 5A.
Figure 6A:
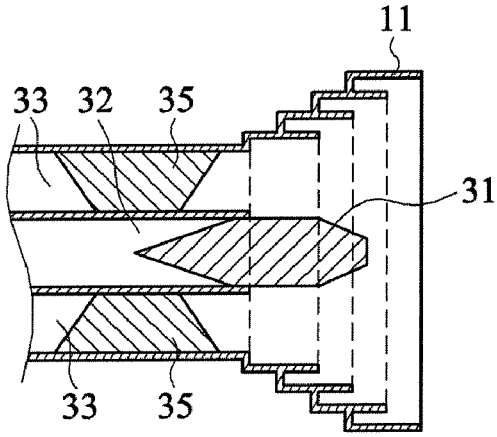
FIG. 6A is a structural diagram of a second band polarizer according to an embodiment of the invention.
Figure 6B:
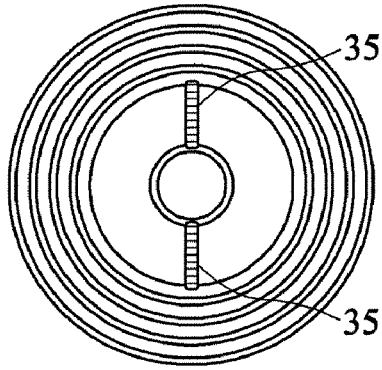
FIG. 6B is a side view of the second band polarizer of FIG. 6A.

In the aforementioned embodiments, the first band polarizer 34 and the core unit 17 can be molded by die-casting as a whole. Although FIGS. 5A and 5B illustrate the first band polarizer 34 to be a stepped type structure, the first band polarizer 34 can also be a continuous-type structure. Referring to FIGS. 6A and 6B, the second band polarizer 35 can be formed by two dielectric slabs and it is inserted into the outer waveguide 33 from the opening of the feedhorn 11.

Figure 7A:
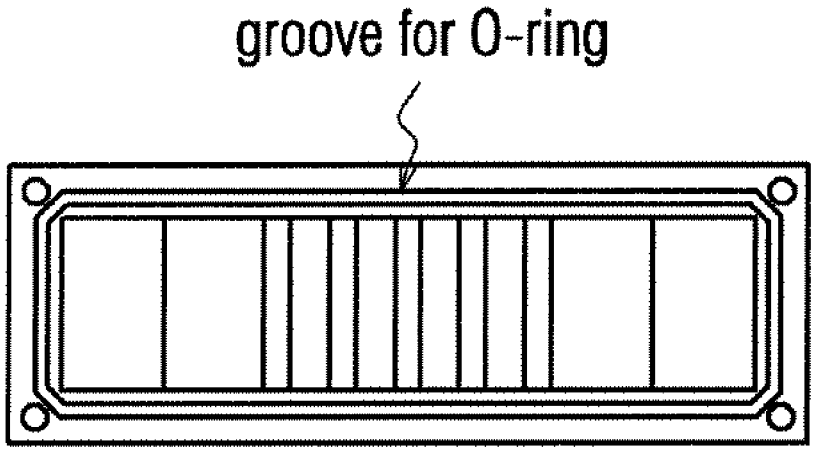
FIG. 7A is a side view of a filter in a branch waveguide according to an embodiment of the invention.
Figure 7B:
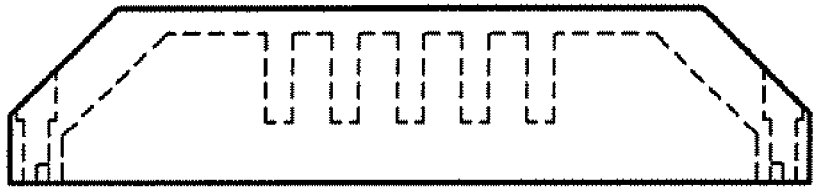
FIG. 7B is a top view of the filter of FIG. 7A.

Signal transmission to satellites requires very high power, and signals are often transmitted at a higher frequency and received at a lower frequency. In a situation where signals are received and transmitted concurrently, interference to signals received at low frequency would easily occur if signal power transmitted at high frequency was strong. Thus, there is a need for better isolation between signals transmitted at high frequency and signals received at low frequency. This is generally achieved by adding a filter. The invention can further include a built-in first band (high frequency) filter in the branch waveguides as shown in FIG. 7, whereby the inclusion saves cost and can be mass-produced by die-casting molding, and especially with a comb-line filter as shown in FIG. 7A and FIG. 7B, mold would be stripped easier during manufacturing.

Figure 8A:
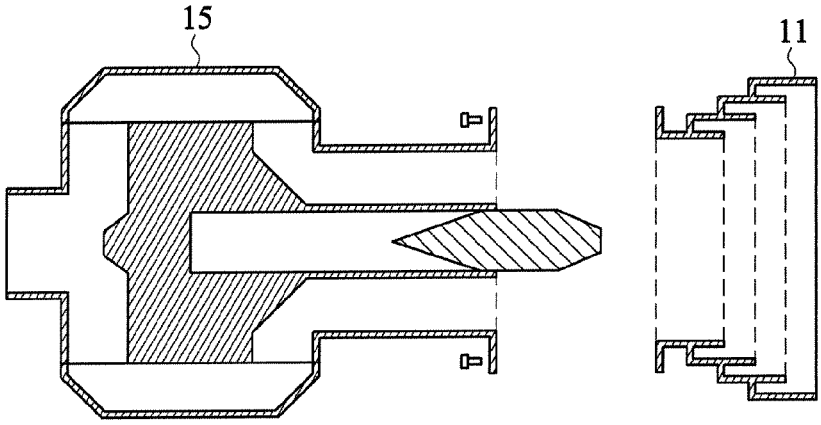
FIG. 8A is a schematic diagram illustrating an assembly of a feedhorn and an OMT according to an embodiment of the invention.
Figure 8B:
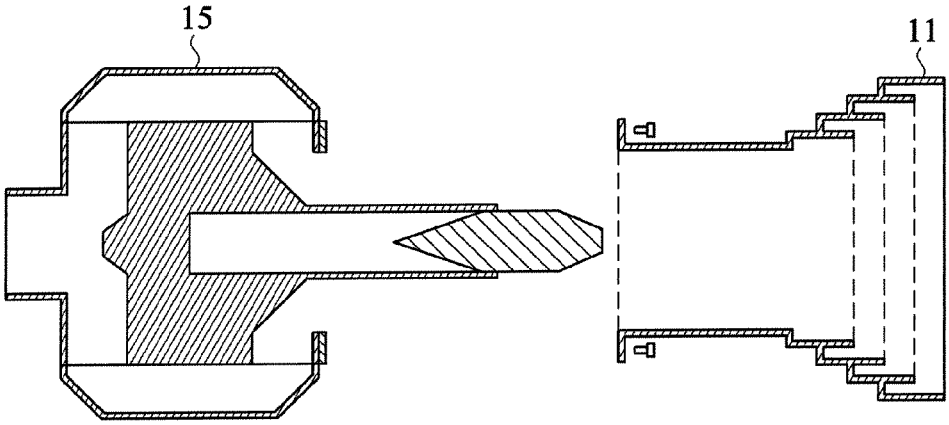
FIG. 8B is a schematic diagram illustrating an assembly of a feedhorn and an OMT according to another embodiment of the invention.

The dual frequency feed assembly according to an embodiment of the invention can be further disassembled into two parts as shown in FIG. 8A or FIG. 8B—the feedhorn 11 and the OMT 12. Junctions between the feedhorn 11 and the OMT 12 are also provided with O-rings for waterproofing purpose. This disassembly can further lower the difficulty of manufacturing assembly components by die-casting molding. FIGS.

8A and 8B are illustrations of different cutting point for the assembly. It is to be noted that any point between the feedhorn 11 and the OMT 12 can be a cutting point, as long as the two can be assembled at the outer wall of the outer waveguide 33 along a plane perpendicular to the first plane. Also, the inner waveguide 32 should be kept whole as shown in FIG. 8B, not be cut at all.

Figure 9:
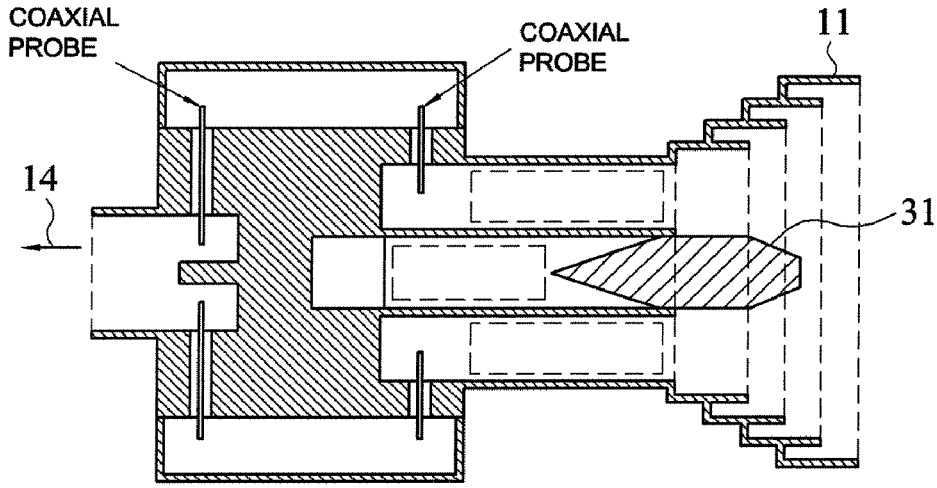
FIG. 9 is a schematic diagram illustrating connections to branch waveguides using coaxial probes.

Moreover, referring to FIG. 9, besides using hollow waveguides as connections between the branch waveguides 15 and the outer waveguide 33 and between the branch waveguides 15 and the second band output/input port 14, coaxial probes and coaxial waveguides can also be used as the connections.

While the invention has been described by way of an example and in terms of the preferred embodiments, it is to be understood that the invention is not limited to the disclosed embodiments. To the contrary, it is intended to cover various modifications and similar arrangements as would be apparent to those skilled in the art. Therefore, the scope of the appended claims should be accorded the broadest interpretations so as to encompass all such modifications and similar arrangements.

What is claimed is:

1. A dual frequency feed assembly for receiving signals of both a first band and a second band lower than the first band, or receiving signals of one of the first band and the second band while transmitting signals of the other band, the dual frequency feed assembly comprising:

an orthogonal-mode transducer, comprising:

a core unit, comprising:

an inner waveguide;

an outer waveguide having a diameter larger than that of the inner waveguide, wherein the outer waveguide and the inner waveguide are concentric;

a first band output/input port connected to the inner waveguide; and a second band output/input port; and at least a pair of detachable branch waveguides disposed with the hollow portion facing the core unit and joined thereto across a first plane substantially parallel to a longitudinal axis of the core unit;

wherein second band signals travel from the outer waveguide to the second band output/input port via at least one of the branch waveguides.

2. The dual frequency feed assembly as described in claim 1, further comprising a feedhorn connected to the orthogonal-mode transducer.

3. The dual frequency feed assembly as described in claim 2, wherein the feedhorn and the orthogonal-mode transducer are produced by die-casting molding separately before being assembled.

4. The dual frequency feed assembly as described in claim 3, wherein the feedhorn and the orthogonal-mode transducer are assembled at the outer wall of the outer waveguide along a plane perpendicular to the first plane.

5. The dual frequency feed assembly as described in claim 1, further comprising:

a first connection for connecting the inner waveguide and the first band output/input port;

a second connection connected to the second band output/input port;

a plurality of third connections for connecting the outer waveguide and the branch waveguides; and a plurality of fourth connections for connecting the branch waveguides and the second connection;

wherein one end of the branch waveguide is connected to the third connection while the other end of the branch waveguide is connected to the fourth connection.

6. The dual frequency feed assembly as described in claim 5, wherein the first connection is a bended waveguide or at least one probe.

7. The dual frequency feed assembly as described in claim 5, wherein the third connections and the fourth connections each is a hollow waveguide, a coaxial waveguide, or a coaxial probe.

8. The dual frequency feed assembly as described in claim 5, wherein the second connection is a hollow waveguide or a probe.

9. The dual frequency feed assembly as described in claim 5, further comprising:

an O-ring provided at a junction between each of the branch waveguides and the third connection or the fourth connection or a junction between the feedhorn and the orthogonal-mode transducer, for water resistance.

10. The dual frequency feed assembly as described in claim 1, wherein the branch waveguides each comprises a waveguide filter.

11. The dual frequency feed assembly as described in claim 1, wherein the number of branch waveguides utilized to receive signals that include second band signals with single polarization is two.

12. The dual frequency feed assembly as described in claim 1, further comprising a dielectric rod provided in the inner waveguide of the orthogonal-mode transducer.

13. A dual frequency feed for receiving dual frequency signals including circularly polarized signals of both a first band and a second band that is lower than the first band or receiving signals of one of the first band and the second band while transmitting signals of the other band, the dual frequency feed comprising:

an inner waveguide;

a first band polarizer provided in the inner waveguide, the first band polarizer being made of a metal septum;

an outer waveguide having a diameter larger than that of the inner waveguide, wherein the outer waveguide and the inner waveguide are concentric;

a second band polarizer;

at least a pair of detachable branch waveguides connected to the outer waveguide;

a first band output/input port for conducting a first circularly polarized signal in the first band and a second circularly polarized signal in the first band to a down converter or a transmitter;

a first connection connecting the inner waveguide and the first band output/input port; and a second band output/input port connected to at least one of the branch waveguides;

wherein the circularly polarized signals of the first band substantially enter the inner waveguide, and the circularly polarized signals of the second band enter the outer waveguide and are conducted to the second band output/input port through the branch waveguides.

14. The dual frequency feed as described in claim 13, wherein the second band polarizer can be a polarizer provided in the outer waveguide or an external polarizer connected to the second band output/input port.

15. The dual frequency feed as described in claim 14, wherein the first connection is two probes or a bended waveguide.

16. The dual frequency feed as described in claim 13, wherein the first connection is two probes or a bended waveguide.

17. The dual frequency feed as described in claim 13, wherein each pair of the branch waveguides are joined to the core unit and substantially parallel to the longitudinal axis of the core unit.

18. A dual frequency feed for receiving dual frequency signals including circularly polarized signals of both a first band and a second band that is lower than the first band or receiving signals of one of the first band and the second band while transmitting signals of the other band, the dual frequency feed comprising:

an inner waveguide;

a first band polarizer;

an outer waveguide having a diameter larger than that of the inner waveguide, wherein the outer waveguide and the inner waveguide are concentric;

a second band polarizer provided in the outer waveguide, the second band polarizer being made of dielectric slabs;

at least a pair of detachable branch waveguides connected to the outer waveguide;

a first band output/input port for conducting a first circularly polarized signal in the first band and a second circularly polarized signal in the first band to a down converter or a transmitter;

a first connection connecting the inner waveguide and the first band output/input port; and a second band output/input port connected to the at least one of the branch waveguides;

wherein the circularly polarized signals of the first band substantially enter the inner waveguide, and the circularly polarized signals of the second band enter the outer waveguide and are conducted to the second band output/input port through the branch waveguides.

19. The dual frequency feed as described in claim 18, wherein the first band polarizer can be a polarizer provided in the inner waveguide or an external polarizer connected to the first band output/input port.

20. The dual frequency feed as described in claim 18, wherein each pair of the branch waveguides are joined to the core unit and substantially parallel to the longitudinal axis of the core unit.

* * * * *